US007311179B1

(12) United States Patent
Franklin

(10) Patent No.: US 7,311,179 B1
(45) Date of Patent: Dec. 25, 2007

(54) ELEVATOR DAMPENING SYSTEM

(76) Inventor: Samuel H. Franklin, P.O. Box 470181, Tulsa, OK (US) 74147

( * ) Notice: Subject to any disclaimer, the term of this patent is extended or adjusted under 35 U.S.C. 154(b) by 392 days.

(21) Appl. No.: 10/760,751

(22) Filed: Jan. 20, 2004

(51) Int. Cl.
*B66B 9/02* (2006.01)

(52) U.S. Cl. ..... 187/270; 187/272

(58) Field of Classification Search ..... 187/272, 187/270

See application file for complete search history.

(56) References Cited

U.S. PATENT DOCUMENTS

| | | | | |
|---|---|---|---|---|
| 105,177 | A | 7/1870 | Copeland | |
| 205,537 | A | 7/1878 | Garrison | |
| 236,184 | A | 1/1881 | Schmidt | |
| 527,894 | A | 10/1894 | Smith | |
| 3,415,343 | A | 12/1968 | Svensson | 187/19 |
| 3,924,710 | A | 12/1975 | Shohet | 187/19 |
| 3,967,703 | A | 7/1976 | Martin | 187/78 |
| 4,046,226 | A | 9/1977 | Flinchbaugh | 187/12 |
| 4,095,681 | A | 6/1978 | David | 188/187 |
| 4,262,777 | A * | 4/1981 | Christopher | 187/253 |
| 4,317,505 | A | 3/1982 | Schneider | 187/17 |
| 4,658,934 | A * | 4/1987 | Cooper et al. | 187/253 |
| 4,807,724 | A * | 2/1989 | Martin | 187/285 |
| 5,499,694 | A * | 3/1996 | Dorn | 187/200 |
| 5,558,181 | A * | 9/1996 | Bundo | 187/270 |
| 5,906,252 | A | 5/1999 | Wang | 187/263 |
| 6,138,799 | A * | 10/2000 | Schroder-Brumloop et al. | 187/252 |
| 6,460,657 | B1 | 10/2002 | Isenberg et al. | 187/245 |
| 6,830,132 | B1 * | 12/2004 | Kang et al. | 187/373 |

* cited by examiner

*Primary Examiner*—Gene O. Crawford
*Assistant Examiner*—Terrell Matthews
(74) *Attorney, Agent, or Firm*—Head, Johnson & Kachigian, P.C.

(57) ABSTRACT

A dampening device for use with elevator cars or similar devices prevents damage to objects or persons within the elevator car upon failure of a drive chain. A hydraulic motor regulates the rate of descent. The dampening motor is monitored constantly using a pressure gauge.

8 Claims, 4 Drawing Sheets

ELEVATOR DAMPENING SYSTEM

BACKGROUND OF THE INVENTION

1. Field of the Invention

The present invention relates to an improved dampening system for elevators and similar devices. More specifically, the present inanition relates to a safety feature that prevents rapid descent of an elevator or similar device.

2. Prior Art

Elevators, trams and other devices for transporting items and people up and down steep slopes and vertically through buildings have been in use for over a century. There has always been a danger that, should the device fail, the elevator car or tram would fall a great distance resulting in damage to goods and death to passengers. Several devices have been designed to operate as brakes to stop a rapidly descending car or tram upon failure of the elevator device.

U.S. Pat. No. 105,177 issued to Copeland on Jul. 12, 1870 discloses in addition to the ordinary brake, a water or other fluid cylinder furnished with a passage connecting the two ends, in such a manner that a valve in the connecting-passage regulates the rapidity with which a piston may be worked by the obstruction it offers to the passage of the water or other fluid, so that the adjustment of the valve regulates the speed of the piston, and fixes the limit at which the car may be permitted to run down the incline. It does not disclose the use of a hydraulic motor safety device attached to the car.

U.S. Pat. No. 205,537 issued to Garrison on Jul. 2, 1878 discloses a safety brake for cars, being more particularly adapted for use on inclines in mines, and which are lowered and raised by means of a wire cable or rope attached to an engine on the surface (typical emergency brake system). This device simply applies frictional force to one of the rails upon which the car rides.

U.S. Pat. No. 236,184 issued to Schmidt on Jan. 4, 1881 discloses a pneumatic braking system. An air powered braking system halts descent of an elevator once a certain speed is reached.

U.S. Pat. No. 527,894 issued to Smith on Oct. 23, 1894 discloses a safety appliance for use in connection with cars upon inclined railways, and it has a stationary or fixed cable in connection with the railway, so arranged with reference to the car upon the track as to permit the gripping of the cable by the gripping mechanism upon the car. This invention provides a safety device that immediately stops the car and does not allow for a slow descent.

U.S. Pat. No. 3,415,343 issued to Svensson on Dec. 10, 1968 discloses a catch apparatus for the elevator cages of scaffold elevators and other similar elevators, on which the elevator cage by means of a driven gear wheel climbs along a toothed rack in a mast structure for the elevator.

U.S. Pat. No. 3,924,710 issued to Shohet on Dec. 9, 1975 discloses a hoist with a rack and pinion drive assembly for raising and lowering the lift frame of the hoist and a rack and pinion overspeed mechanism for braking the lift frame when the hoist exceeds a predetermined speed.

U.S. Pat. No. 3,967,703 issued to Martin on Jul. 6, 1976 discloses a rack-and-pinon type hoist with an improved braking apparatus that includes a spring buffer, preferably hydraulic, carried by the cage of the hoist, a rotatable shaft also carried by the cage and positively engaged with a member extending along the mast so as to be driven in rotation by movement of the cage along the mast and connecting means for engaging the shaft and the buffer comprising a centrifugal governor driven by rotation of the shaft and operating, in response to rotation of the shaft in excess of a predetermined rate of rotation, to provide positive drive to a linearly movable member, the movement of which is opposed by the buffer.

U.S. Pat. No. 4,046,226 issued to Flinchbaugh on Sep. 6, 1977 discloses an elevator platform that rides on parallel tracks which may be adapted for vertical or inclined conveyance. Each track is slotted along its length, through which slot the platform extends and is connected to a trolley driven by a continuous chain. Each track is tubular and generally rectangular, and each encloses another tubular, rectangular member which provides a space for the chain return and electrical conduits, and which provides support for the trolley. Each trolley has an upper pair of rollers bearing against the inside of the hollow track straddling the slot, and lower rollers bearing against the top surface of the inner tubular member. Interrupt and safety precautions are provided based on chain breakage, excessive speed, overload, or contact with foreign objects in the path of the elevator platform. The safety precautions provide for an immediate stop The designs of the prior art designed to detect when an elevator car accelerates passed a predetermined speed. The device then rapidly stops the elevator car. This sudden stops jerks what ever is in the car and can cause damage to products and injure passengers. In addition, the car may be stopped at an inconvenient spot. An elevator may be caught between floors and a tram may be stopped only halfway down its track and difficult to get to. None of the prior art discloses means for slowing down rather than stopping an elevator car. Neither do they provide means for an elevator whose power has failed to safely fall to the bottom of its track.

It is therefore desirable to provide an elevator dampening system that does not suddenly stop an elevator car thus jarring its contents.

It is also desirable to provide a dampening system that allows an elevator car to slowly return to the bottom of a shaft or track.

SUMMARY OF THE INVENTION

The present invention provides a dampening system for use on elevator cars and other devices designed to ascend and descend vertically or at a steep angle. The invention provides a hydraulic motor having a cog attached to it. The cog is engaged to a track that runs parallel to the drive mechanism. Typically, this type of hydraulic motor is used to provide high torque, low RPM motion. Here, the motor is used in an opposite fashion. Those skilled in the art will appreciate that a cog attached to a hydraulic motor may be spun with relatively little effort in one direction but provides a significant amount of resistance when one attempts to spin it in the other direction due to a check valve. The resistance provided by the motor in the second direction is used to regulate the speed of descent of an elevator car. The hydraulic motor is attached to an elevator car in such a way that the cog applies resistance to the track it is engaged to as the elevator car descends. No substantial resistance is applied by the motor to its track when the elevator car is moved upward. No power is required for this design. It requires only the track, a cog attached to a hydraulic motor and a hydraulic fluid reservoir for the motor.

Those skilled in the art of hydraulics will appreciate that the resistance of the hydraulic motor is due to pressure buildup within the motor. A pressure gauge may be used to measure this pressure. Such a pressure valve is a useful monitoring device. The valve may be mounted on the elevator car such that it may be viewed by operators of the elevator. So long as the pressure valve measures pressure within the hydraulic motor as it descends, operators may be assured that the safety feature is operating properly. Failure of the gauge to detect any pressure serves as a warning that the hydraulic motor safety device is not operating properly. Those skilled in the art will appreciate that this easy constant monitoring of the safety valve is an improvement over the prior art.

The addition of the invention to an elevator or other device designed for the ascending and descending of a car, tram or other object limits the rate at which the device may descend. Should the drive chain of the elevator break or otherwise fail, the car will descend at a safe speed until it has reached the bottom. This avoids the jerking motion caused by most safety systems when they suddenly stop the car in place. This also prevents a car from being stopped at an awkward position along its track. It is both safer and more convenient than devices of the prior art.

In an alternative embodiment of the present invention, the hydraulic motor may be stationary at the top of an elevator shaft. The elevator car to which it is engaged is attached to the hydraulic motor by a chain or cable and moves up down within the elevator shaft. In this embodiment the hydraulic motor may also be used as the drive mechanism. By pumping hydraulic fluid through the hydraulic motor rather than allowing it to rest idly, an elevator car may be pulled upward. In this embodiment, it is preferable to use two hydraulic motors each with a separate chains or cables attached to the elevator car. In this embodiment, if either chain or cable breaks or fails, the second one and its motor will present the car from falling. It is also possible to add a spring activated, hydraulically released brake to the hydraulic motor shaft if no further descent is desired when a failure is detected, thus the motor stops the tram and the brake holds the load.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularly, it is to be noted that many modifications may be made in the details of the invention's construction and the arrangement of its components without departing from the spirit and scope of this disclosure. It is understood that the invention is not limited to the embodiments set forth herein for purposes of exemplification.

In the present invention a high torque low RPM hydraulic motor is utilized to control the descent of an elevator car down an elevator shaft. In one embodiment, the hydraulic motor is attached to an elevator car. The motor has a cog attached to it that rides along a stationary track that extends the length of the shaft. When the elevator descends, pressure builds up within the hydraulic motor and the speed with which the cog may turn and move down the track is limited. When the cog turns in the other direction as it ascends the shaft, no pressure builds within the hydraulic motor due to a check valve and the cog rotates freely thus not limiting the speed with which the elevator may ascend the shaft. Those skilled in the art will appreciate that all hydraulic motors rotate easily in one direction due to a check valve but only slowly in the opposite direction due to a relief valve. It is this property that makes them well suited as a safety feature for use with elevator cars and other devices that ascend and descend a vertical or steep angle.

Figure 1:
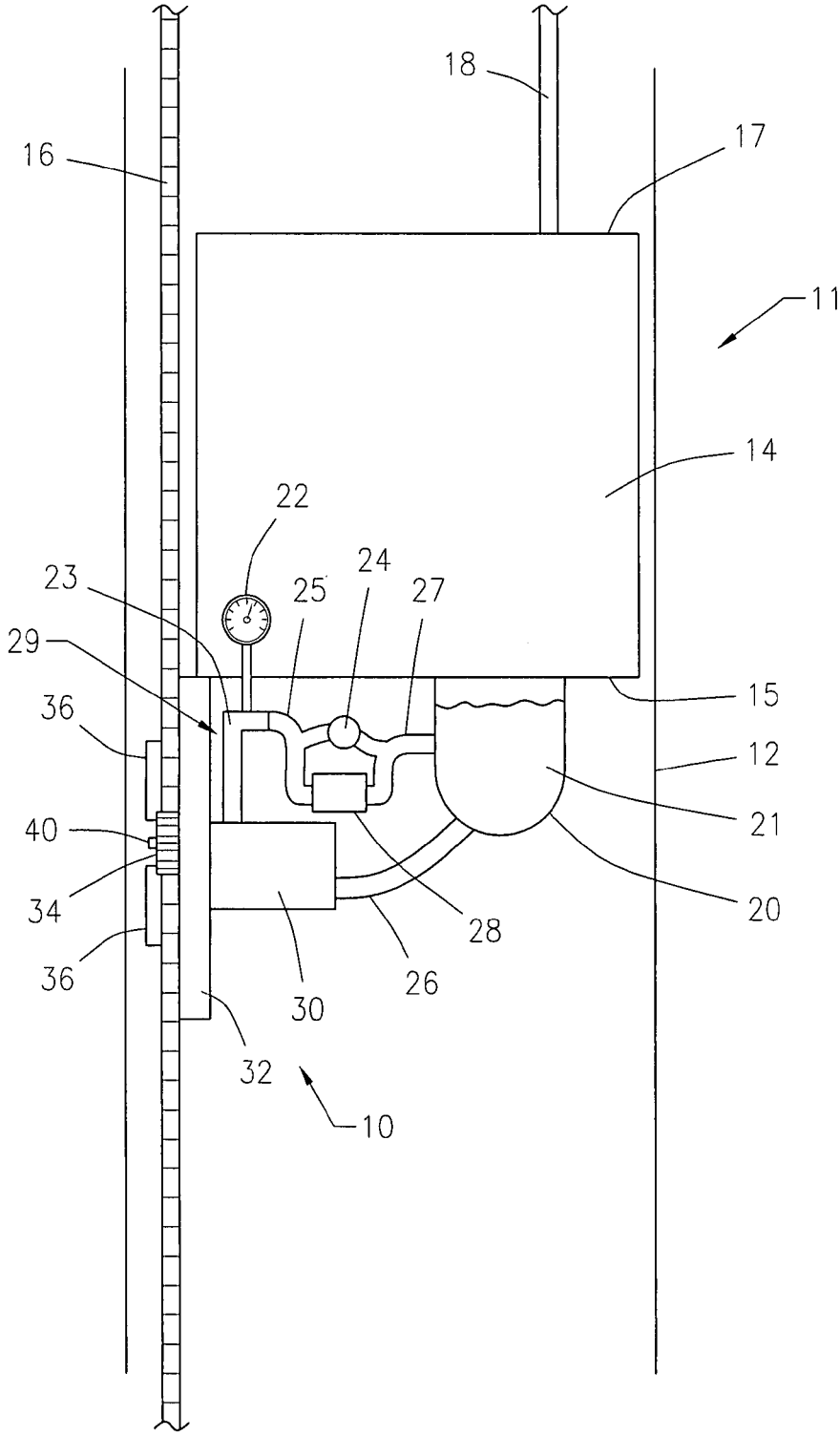
FIG. 1 shows a diagrammatic side view of the invention.

FIG. 1 shows a dampening system 10 as used in an elevator assembly 11. Elevator car 14 has cable 18 attached to its top 17. Cable 18 is attached to a standard elevator drive mechanism not shown. Dampening system 10 is attached to the bottom 15 of car 14. Dampening system 10 has a hydraulic motor 30 attached to support bracket 32. Hydraulic fluid is fed to motor 30 by assembly 29 and tube 26. Assembly 29 and tube 26 connect to reservoir 20 which is full of hydraulic fluid 21.

Track 16 runs the length of the elevator shaft 12 and is stationary. Track 16 is engaged to cog 34 which is attached to axle 40 of the hydraulic motor 30. Guide rollers 36 hold track 16 firmly engaged to cog 34. Motor 30 is arranged in such a way that cog 34 places a substantial amount of resistance to track 16 as the elevator car 14 descends. No substantial resistance is applied to track 16 by cog 34 as the elevator ascends. Should cable 18 or the drive mechanism fail, dampening system 10 causes the elevator car to descend relatively slowly.

Assembly 29 is comprised of pipe 23, pressure gauge 22, tubing 25, check valve 24, relief valve 28 and tubing 27. Check valve 24 only allows flow of a fluid in one direction. Here, check valve 24 allows hydraulic fluid to flow through it from reservoir 20 to motor 30 through tubes 27 and 25 and pipe 23. It does not allow fluid 21 to flow in the opposite direction. Relief valve 28 allows fluid 21 to flow through it in one direction only. However, relief valve 28 allows flow only at a very slow rate. This rate may be adjusted. Those skilled in the art will appreciate that this is a common design for hydraulic assemblies used with hydraulic motors. When fluid 21 flows from reservoir 20 through tubing 27 and valve 24 through tubing 25, pipe 23 and into motor 30, the fluid flows relatively easily and allows the axle 40 of hydraulic motor 30 to spin freely and rapidly. Fluid 21 travels through tube 26 and back into reservoir 20. When fluid flows in the opposite direction check valve 24 closes and fluid may only flow through relief valve 28. Relief valve 28 restricts the flow rate by a pre-determined amount. As cog 34 turns while descending track 16, it rotates axle 40 so that fluid 21 gets pumped through tube 26 and motor 30 and forced into pipe 23 and tube 25. Because relief valve 28 only allows flow at a very slow rate, pressure builds in assembly 29 and is measured by pressure gauge 22. This slows the rate by which axle 40 may turn and allows the elevator to only descend slowly. It may also be desirable to have the relief valve attached to controls which may be actuated from within the elevator car such that the speed of descent may be adjusted.

Pressure gauge 22 monitors the pressure that builds in the motor 30 and line 25 when car 14 descends. Operators of the elevator may use this gauge to verify that dampening system 10 is operating properly. The pressure gauge 22 does not measure an increase in pressure as the elevator car 14 descends, when dampening system 10 has failed and is not working. This will alert operators of the elevator to the fact that dampening system 10 is not operating properly.

Figure 2:
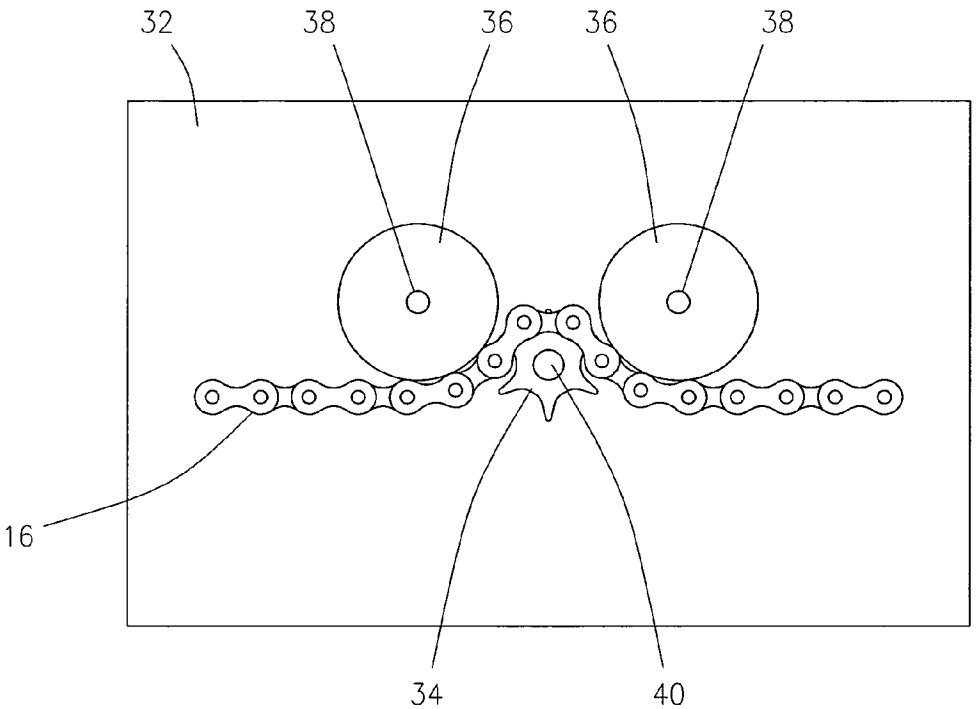
FIG. 2 shows a diagrammatic view of the cog, track and guide rollers of the invention.

FIG. 2 shows how cog 34 engages track 16. Cog 34 is attached to axle 40 that connects it to the hydraulic motor on the opposite side of support bracket 32. Rollers 36 freely rotate about pivot pins 38. Rollers 36 push track 16 firmly against cog 34 to ensure that track 16 and cog 34 remain firmly engaged.

Figure 3:
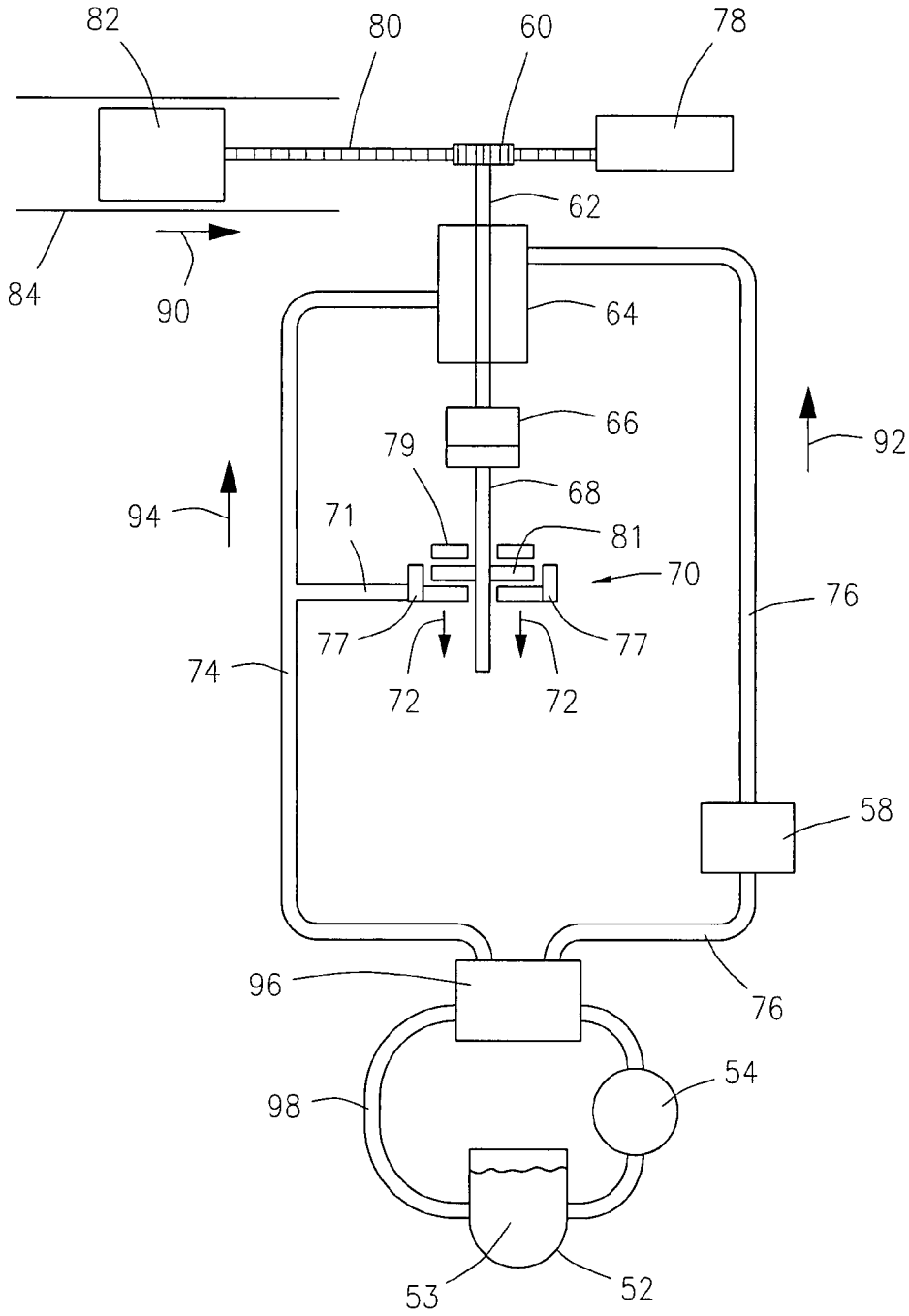
FIG. 3 shows a diagrammatic side view of an alternative embodiment of the present invention.

FIG. 3 shows an alternative embodiment of the present invention. Elevator drive mechanism 50 is designed to both raise and lower elevator car 82. It incorporates an additional safety feature designed to stop the elevator at any given point. Hydraulic motor 64 is attached to axle 62 that operates on cog 60. Cog 60 rotates and is engaged with chain or cable 80. When cog 60 rotates in a direction to lift car 82 in the direction of arrow 90 the chain or cable 80 is drawn into retention box 78. When car 82 is moved in the downward direction the retention box 78 feeds the chain or cable to cog 60 and down shaft 84. In order to raise car 82 in the direction of arrow 90, pump 54 pumps fluid 53 into four-way valve 96. Four-way valve 96 with integral pressure relief valve which contains pump pressure is actuated such that it feeds the fluid into tube 76. Those skilled in the art will appreciated that a four-way valve is capable of directing flow of a hydraulic fluid pumped into it into more than one output tube. When lifting car 82, four-way valve 96 is actuated such that fluid 53 is pumped into tube 76 and not tubes 74 and 98. Tube 76 has a relief valve 58. Relief valve 58 has an internal check valve. Those skilled in the art will appreciate that such a relief valve 58 having an internal check valve allows free flow of fluid in one direction and restricted flow in the other direction. Here, valve 58 allows free flow of fluid in the direction of arrow 92 but restricts flow in the opposite direction. Fluid travels through 76 and into motor 64 causing axle 62 and cog 60 to rotate in a direction so as to lift car 82 in the direction of arrow 90. As car 82 is lifted, chain or cable 80 is pulled into retention box 78 where it is stored. Fluid 53 continues to flow through motor 64 and into tube 74 in a direction opposite of arrow 94. The fluid then travels back into four-way valve 96 where it is directed into tube 98 and returned to reservoir 52. As will be discussed in more detail below, axle 62 is engaged with overriding clutch 66. Those skilled in the art will appreciated that an overriding clutch generally allows free rotation in one direction but prevents rotation in another direction. Overriding clutch 66 is engaged by axle 62 in such a way as to allow free rotation in the direction that rises car 82 and prevents rotation in the opposite direction. Should the apparatus somehow fail while raising car 82, overriding clutch 66 will hold car 82 in place where it was stopped. It will prevent car 82 from descending.

Once car 82 has attained a desired elevation, four-way valve 96 is actuated to direct fluid pumped into it by pump 54 directly into tube 98 and no longer into tube 76. The action of overriding clutch 66 on axle 62 holds car 82 in place where it was stopped.

Finally, to descend elevator car 82, the four-way valve 96 is actuated such that fluid pumped by pump 54 is sent into tube 74. As with the previous embodiment, the use of a check valve builds up pressure within the hydraulic motor and limits the rate of descent. Fluid 53 also flows into fluid tube 71 and to a disk brake system 70. Those skilled in the art will appreciate that disk brake systems are well known. Typically, pads 79 and 77 compress against disk 81 and prevent axle 68 from rotating. However, because of the engagement of axle 68 and axle 62 by means by overriding clutch 66, axle 62 may not move in a rotation that allows descent of car 82 unless axle 68 is also capable of rotating. To facilitate this, fluid 53 fed to disk brake system 70 by tube 71 actuates pads 77 such that they move in the direction of arrows 72. This releases pressure on disk 81 and allows axle 68 to rotate with axle 62. Should the system fail in some manner and cause the pressure of hydraulic fluid 53 within the tube 74 and 71 to decrease, pads 77 will re-engage disk 81 and stop descent of car 82. Should overriding clutch 66 fail in some manner, the rate of descent remains controlled by the internal check valve 58 and the pressure build up in hydraulic motor 64. Those skilled in the art will appreciate that this dual safety system comprised of both a hydraulic motor having a controlled rotation rate as well as an overriding clutch provides for a very safe elevator system. Those skilled in the art will appreciate that a drive mechanism such as that shown in FIG. 3 may be used to lift and lower an elevator car without the inclusion of overriding clutch 66 and disk brake mechanism 70. However, the embodiment shown in FIG. 3 is preferred because it is safer.

Figure 4:
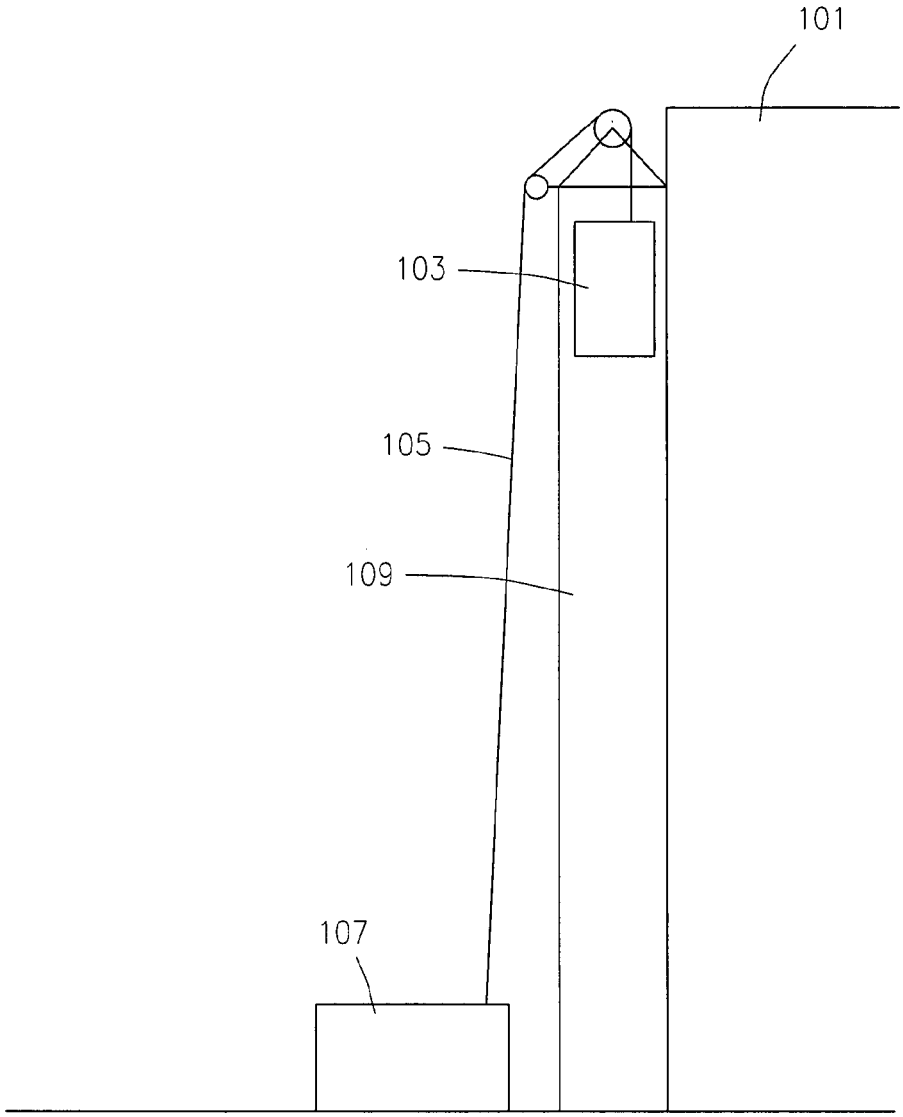
FIG. 4 shows an alternative embodiment of the present invention.

In FIG. 1, the dampening device is shown attached directly to the elevator car. Those skilled in the art will appreciate that although the figure shows the device attached to the bottom of the car, it may also be attached to the top of the car. In addition, it may also be completely detached from the elevator car. FIG. 4 shows an elevator car 103 and a shaft 109 located on the side of a building 101. The dampening device is located in base 107. Cable 105 attaches it to a car 103. When the device is activated, it slowly lowers the elevator. This may be used as a means to escape a tall building in case of a fire. The elevator would only descend once. Base 107 is located outside the building to prevent it from being damaged by a fire or other tragedy.

The device shown in FIG. 3 may also be placed in base 107 so that the elevator may both ascend and descend. Base 107 is a safe distance from the building so that it will not be damaged in case of an emergency. Those skilled in the art will appreciate that shaft 109 may be located within building 101. However, for use as an emergency escape mechanism, it is preferred that the elevator be on one end of the building instead of inside the building.

The embodiments of the invention shown in FIGS. 1 through 4 are all designed for an elevator car within an elevator shaft. However, those skilled in the art will readily realize that the device is suitable for use on any cars or trams that ascend and descend either vertically or at an angle. A variety of devices are designed to transport objects or persons up or down the slope of a hill or mountain. The present invention is highly suitable for use in conjunction with such devices.

Whereas, the present invention has been described in relation to the drawings attached hereto, it should be understood that other and further modifications, apart from those shown or suggested herein, may be made within the spirit and scope of this invention.

What is claimed is:

1. An elevator dampening device comprising:

a hydraulic motor having an axle;

a hydraulic fluid reservoir in fluid communication with the hydraulic motor;

a relief valve in fluid communication with the motor and the reservoir;

a check valve in fluid communication with the motor and the reservoir;

hydraulic fluid in the hydraulic fluid reservoir and the motor;

a cog attached to the axle of the hydraulic motor and the cog having an alternating series of radially projecting teeth and grooves;

a pair of guide rollers being axially spaced and coaxially parallel;

a non-rigid track having a series of projecting teeth fitting into the series of grooves on the cog;

wherein said cog is offset perpendicularly from said axis of said guide rollers;

wherein said guide rollers cause the track to firmly engage the cog;

wherein the cog substantially resists downward motion along the track; and wherein said non-rigid track comprises at least one roller chain attached to a structure above an elevator car containing a load, said at least one roller chain allowing said elevator car to move up and down along said at least one roller chain.

2. The device of claim 1 further comprising a pressure gauge for measuring pressure in the hydraulic fluid caused by downward motion of the device along the roller chain.

3. The device of claim 1 further comprising control means for adjusting flow rate within the relief valve.

4. An elevator dampening device comprising:

a hydraulic motor having an axle;

a hydraulic fluid reservoir in fluid communication with the hydraulic motor;

a relief valve in fluid communication with the motor and the reservoir;

a check valve in fluid communication with the motor and the reservoir;

a drive pump in fluid communication with the motor and the reservoir;

hydraulic fluid in the hydraulic fluid reservoir and the motor;

a cog attached to the axle of the hydraulic motor and the cog having a series of radially projecting teeth;

a pair of guide rollers being axially spaced and coaxially parallel;

at least one drive chain having individually addressable links fitted into one another to receive said radially projecting teeth on the cog;

wherein said cog is offset perpendicularly from said axis of said guide rollers;

wherein said guide rollers cause the drive chain to firmly engage the cog;

wherein the cog substantially resists downward motion of the drive chain; and, wherein the drive pump actuates the cog to cause upward motion of along the drive chain.

5. The device of claim 4 further comprising a pressure gauge for measuring pressure in the hydraulic fluid caused by downward motion of the device along the drive chain.

6. The device of claim 4 further comprising control means for adjusting flow rate within the relief valve.

7. The device of claim 4 further comprising a overriding clutch and a disk brake mechanism.

8. The device of claim 4 wherein said drive chain is attached to a structure above an elevator car containing a load allowing the elevator car to move along said drive chain.

* * * * *